US005687663A

United States Patent [19]

Wahlstrand

[11] Patent Number: 5,687,663

[45] Date of Patent: Nov. 18, 1997

[54] BOAT LIFT TRANSPORT APPARATUS

[76] Inventor: Noel D. Wahlstrand, 14025 - 140th Ct., Apple Valley, Minn. 55124

[21] Appl. No.: 666,083

[22] Filed: Jun. 19, 1996

[51] Int. Cl.[6] ..... B63C 7/00

[52] U.S. Cl. ..... 114/44; 405/3

[58] Field of Search ..... 114/44, 45, 48, 114/49, 52; 405/3; 414/460

[56] References Cited

U.S. PATENT DOCUMENTS

| | | | |
|---|---|---|---|
| 3,265,024 | 8/1966 | Kramlich | 114/45 |
| 3,951,087 | 4/1976 | Carson | 114/45 |
| 4,027,492 | 6/1977 | Carpenter | 114/45 |
| 4,280,429 | 7/1981 | Wells | 114/45 |
| 4,318,632 | 3/1982 | Fortmeyer | 405/3 |
| 4,787,327 | 11/1988 | Porter | 114/44 |
| 5,016,685 | 5/1991 | Fender | 114/45 |
| 5,156,493 | 10/1992 | Johnson | 405/221 |
| 5,211,124 | 5/1993 | Reiser | 114/44 |

OTHER PUBLICATIONS

V–dock Installation Instructions, by R & D Manufacturing Inc., 1 sheet (2 sides) at least as early as Jun. 1, 1995 (admitted prior art).

V–dock Advertising brochure, by R & D Manufacturing Inc., 1 sheet (2 sides) at least as early as Jun. 1, 1995 (admitted prior art).

"ShoreMaster's " brochure, published Mar. 1995.

"ShoreStation Boat Hoist" brochure, publication date unknown (admitted prior art).

*Primary Examiner*—Jesus D. Sotelo

*Attorney, Agent, or Firm*—Westman, Champlin & Kelly, P.A.

[57] ABSTRACT

A transportable boat lift having a base and a boat support frame that is mounted on the base for movement between a lowered position and a raised position. The boat lift is installed in a lake or river so that the boat support frame supports the boat in a desired location, either above the water level or close to it. In a lowered position, the boat that is supported on the boat support frame will be floating for use. The boat lift includes a transport mechanism that permits easily installing and removing the boat lift by having one or more float rollers that are actuated to float the boat lift when the boat lift is moved from its lowered position to its raised position. The float rollers are forced downwardly relative to the base to float the boat lift in the water, and when the boat lift is moved toward shore the rollers act as wheels for permitting the boat lift to be easily moved up the shore to a storage position.

13 Claims, 4 Drawing Sheets

FIG.8
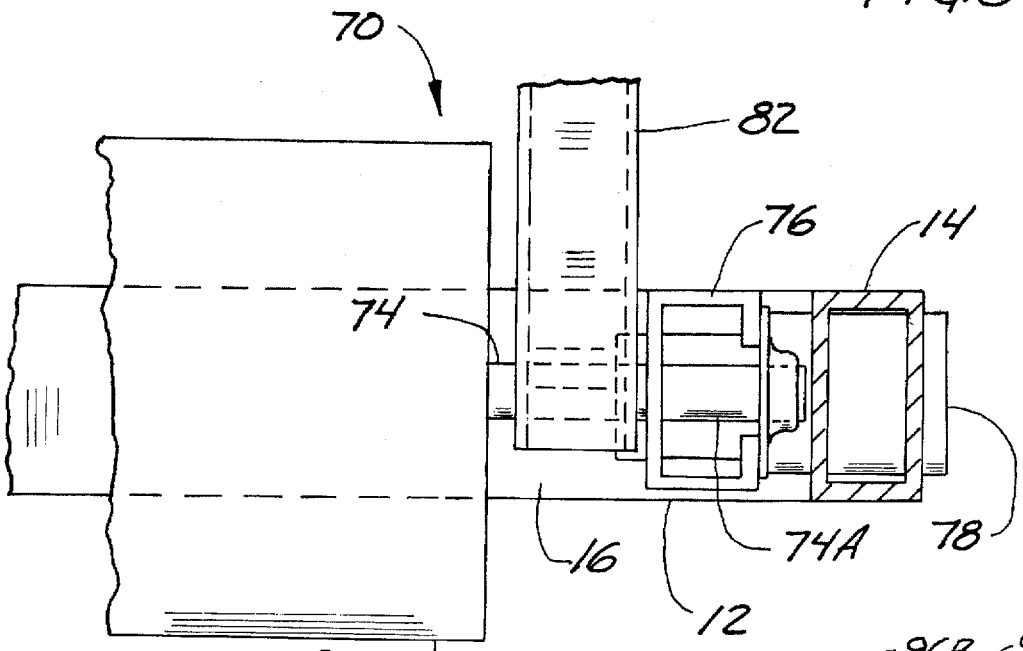
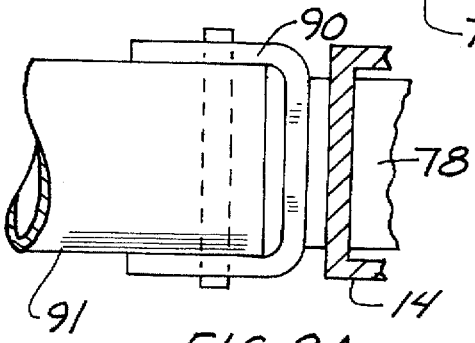
FIG.8A
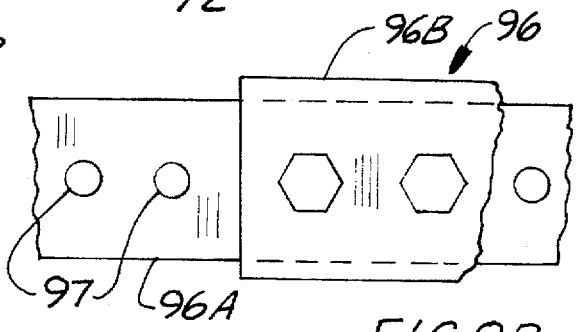
FIG.8B
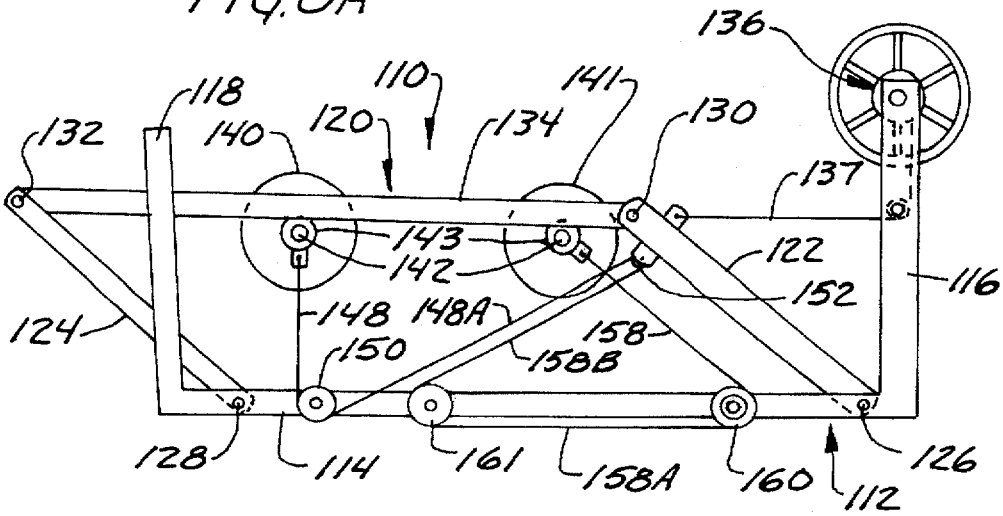
FIG.9

BOAT LIFT TRANSPORT APPARATUS

BACKGROUND OF THE INVENTION

The present invention relates to a transport apparatus for a boat lift that is placed in bodies of water, such as lakes and rivers, and which normally is removed during the winter and reinstalled in the spring.

Transportable boat lifts have been used previously, and a typical arrangement is shown in U.S. Pat. No. 4,027,492. This patent shows a frame that forms a base that rests on the bottom of the body of water and has a pivotally mounted boat support frame that is moveable on the base between lowered and raised positions. In U.S. Pat. No. 4,027,492, cable actuators are used for moving the boat support frame between its two positions, and floats can be attached that will float the base as the floats are pulled toward the boat lift base by movement of cables.

Various other devices have been used for moving boat lifts and docks in position utilizing removable wheels, for example, and one such arrangement is shown in the brochure for the V-dock made by R & D Manufacturing, of Forest Lake, Minn., under U.S. Pat. No. 5,156,493, which requires installation of foam rollers or wheels for floating dock sections.

It is also well known to utilize a moveable upper boat support lift frame that is supported on a base using parallel link supports for holding the boat support frame generally parallel as it is raised or lowered. Winches used for operating boat lifts are also well known, as illustrated in U.S. Pat. No. 5,211,124.

SUMMARY OF THE INVENTION

The present invention relates to a simplified boat lift transport apparatus for installation and removal of a boat lift, having one or more floats that are actuated by operation of the boat lift. In a preferred embodiment a conventional boat lift base frame is shown, including longitudinal side members and cross members. A boat support frame is connected to the base through parallel arm linkages that pivot from a position wherein the boat support frame is above the surface of the water in which it is installed to a lowered position wherein a boat on the boat support frame would be floating. The movement of the boat support frame relative to the base is controlled in a conventional manner through the use of cables and pulleys operated by a manual winch. A powered winch or other power operator could also be used.

The invention comprises a linkage for supporting a float roller that is moved to support the boat lift as the boat support frame is actuated. The float roller has a central axle or pipe so that the roller can roll and arms or linkage provided will rotatably mount the float rollers between the side members of the boat lift base. As shown, further set of actuator arms is pivotally mounted onto the movable boat support frame, which are pivoted in position and of a length selected so that when the boat support frame is raised, the actuator arms move the float roller to a position to float the boat lift. The pivots of the actuator arms are coaxial and spaced horizontally from the axle of the float roller a distance greater than the length of the mounting arms. As the boat lift frame is raised through the use of a winch and cable arrangement, the ends of the actuator arms move into engagement with the axle of the float roller, and as the boat lift frame is further raised, the actuator arms cause the boat lift float roller to be moved downwardly relative to the surface of the water and float the boat lift, at least on one end. When the boat lift frame is fully raised, the actuator arms will force the float roller down toward the base to a position where the lower edge of the float roller is below the boat lift base. The float roller will then act as a wheel on the bottom of the body of water and on land when the boat lift is moved out of the water.

At least one float roller and actuator arm assembly is utilized on each boat lift, and will provide wheel support and floatation for installation and removal. When a single float roller is used, as shown, suitable wheels can be placed on the shore end of the boat lift frame, if desired, as the boat lift is pulled to shore for permitting the boat lift frame to be rolled on such wheels and on the provided float roller. Two float roller assemblies can be utilized with the boat lift for a complete lifting, supporting and rolling action.

The actuation is simple, and can be used on conventional frames by merely adapting the frames to receive the pivoting roller mounting arms and actuator arms. Various arrangements for the control cables can be utilized and, if desired, the boat lift frame rollers can be independently supported and then moved into the floating position by having the axles for the rollers operated through separable cable connections or power actuators.

The float rollers can be made from barrels, or can be made of a suitable foam material with sufficient support frame work for ensuring that the axle will support the weight of the boat lift as it is installed or removed.

BRIEF DESCRIPTION OF THE DRAWINGS

FIG. 8 is a front view of the float roller shown in FIG. 7;

FIG. 8A is a schematic showing of a channel shaped arm used with the present invention;

FIG. 8B is a schematic showing of an adjustable mounting arm used with the present invention; and FIG. 9 is a schematic representation of a modified form of the invention illustrating a cable actuating arrangement for lowering float rollers into position for use.

DETAILED DESCRIPTION OF THE PREFERRED EMBODIMENTS

Figure 1:
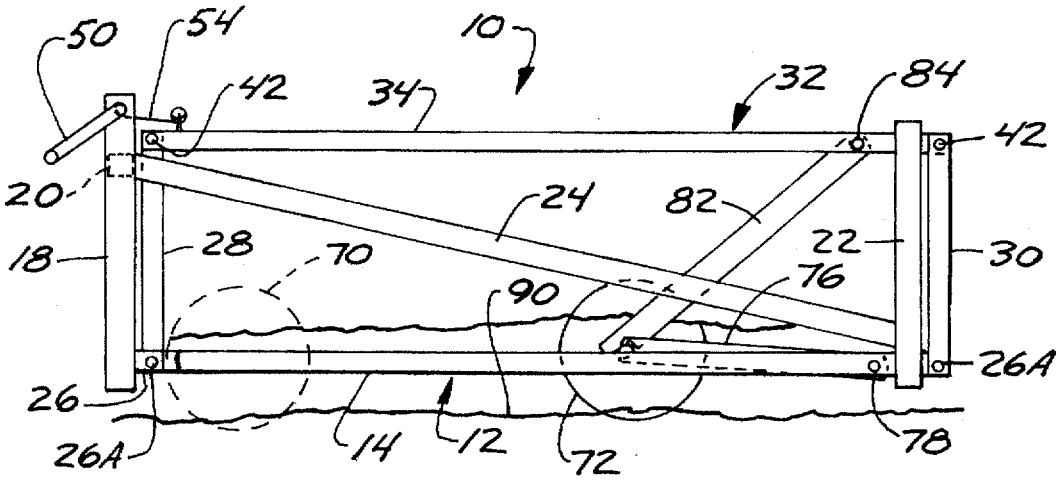
FIG. 1 is a schematic side elevational view of a boat lift having a float and transport apparatus made according to the present invention installed thereon and as shown in a transport position.

A boat lift and transport mechanism illustrated generally at 10 is used for lifting a boat support frame 32 from a position below the surface of a body of water to a position wherein the bottom of the boat on the boat support frame 32 is near or above the water surface. The boat will float, of course, when the boat support frame 32 is in a lowered position so that the boat can then be used. This general arrangement of a boat lift is widely used for relatively small boats in inland waters. Manually controlled or power arrangements are made for raising and lowering the boat.

The present invention includes a boat lift installation and removal float roller apparatus that will permit floating the boat lift into position, and then lowering it into place by operating the boat lift frame. When the boat lift is to be removed from a lake, as is commonly done in colder climates, the float roller or drum is actuated to float the boat lift back to a position where it can be pulled onto shore, and the roller or rollers will act as wheels or support rollers for moving the boat lift on the ground surface. The boat lift and transport assembly 10 has a base frame 12. The base frame 12 is a rigid assembly of a pair of generally horizontal, longitudinal stringers or frame members 14 that are laterally spaced apart, and held together with cross members 16. Upright posts are provided at each of the corners of the base. The posts include a first pair of posts 18 at a shore end of the boat lift base, which are supported together with a top cross member 20, as perhaps best seen in FIG. 4. A pair of upright guide posts 22, 22, are at the lake or deeper water end of the boat lift base 12. Diagonal braces 24 are provided between the base ends of the upright guide posts 22 and the upper portions of the posts 18.

Figure 5:
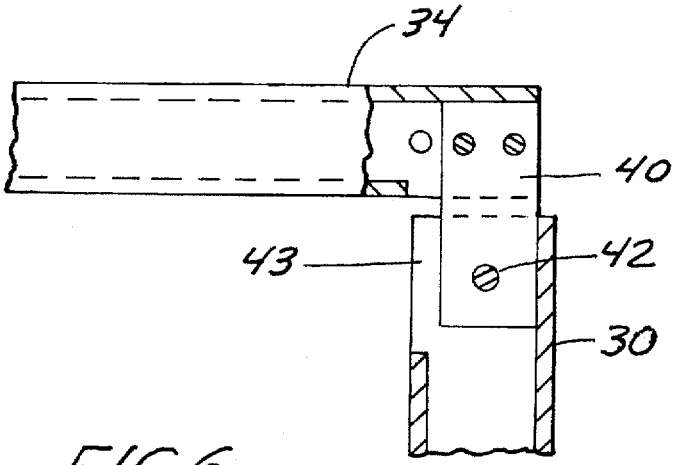
FIG. 5 is an enlarged sectional schematic view of a typical pivoting joint that is used for the boat support frame of the present invention.
Figure 6:
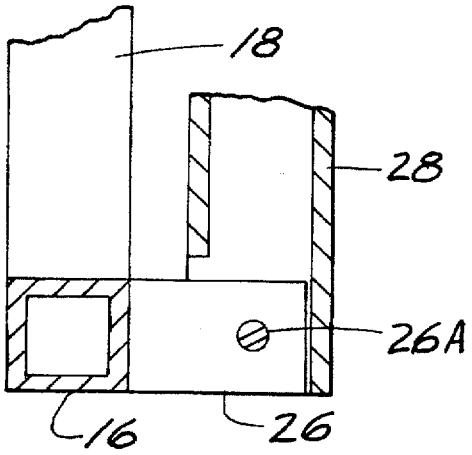
FIG. 6 is an enlarged view of a typical lower pivot between the boat lift base and boat support frame of the present invention.

The base cross members 16 are schematically shown with pivot structures for the boat support frame. The existing boat lifts can be used so the boat lift is shown schematically for illustration. The base cross members 16 are each provided with two pairs of ears 26, 26, that form pivot supports for a pair of shore end parallel arms 28, 28, and a pair of lake end parallel arms 30, 30. The arms 28 and 30 are pivotally mounted to the respective pairs of support ears 26, about horizontal pivots shown schematically at 26A. The upper ends of the pairs of arms 28 and 30 are pivotally mounted to the boat support frame 32. The boat support frame 32 is an assembly of a pair of longitudinal stringers 34, 34, that are spaced to the inside of the upright posts 22 and the diagonal braces 24, and thus also to the inside of or between the longitudinal stringers 14, 14. The longitudinal boat support frame stringers 34, 34 are held together with cross members 36, 36, so that the boat support frame 32 is a rigid assembly. The ends of the longitudinal stringers 34, 34, are supported on the parallel linkage arms 28, 28, and 30, 30, respectively, through pivot assemblies that can be of any desired form. As shown in FIG. 5, specifically, one wall of an end of the longitudinal stringers 34 is cut away (the longitudinal members and other frame members are square or rectangular cross section tubes, preferably) and a pivot block 40 is bolted to the ends of the stringers. The blocks 40 each have a depending end portion 40A that is received in the respective upright post, as shown typically in FIG. 5, one of the arms 30. The blocks 40 are pivotally mounted on the interior of the respective arm 28 or 30 with a suitable pin 42. The upright arms 28 and 30 are rectangular or square tubes, as shown, and are recessed or cut away as at 43 to provide for clearance for pivoting. The ear 40 can be attached to the longitudinal stringers 34 in any desired way, and as shown, can be bolted in place, or they could be welded in place. The existing boat support frames can be used.

Figure 2:
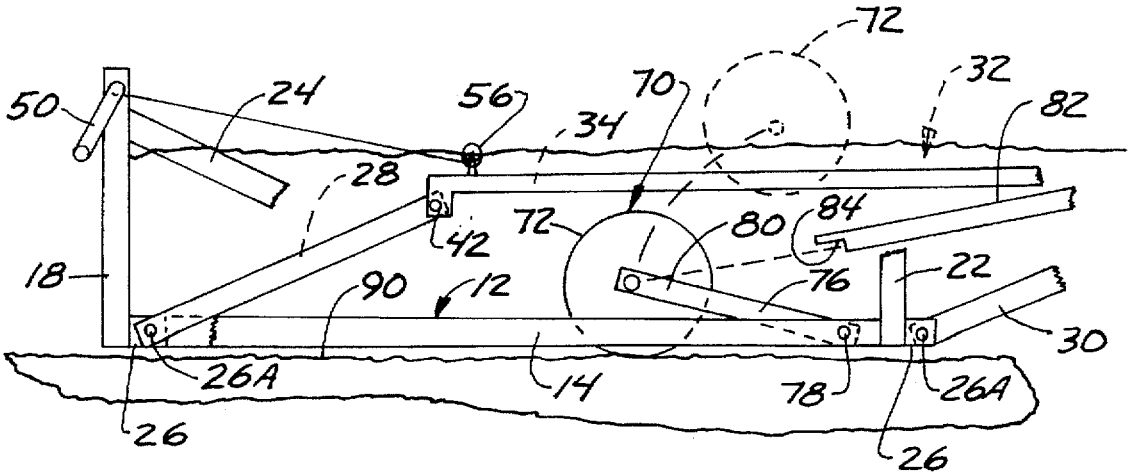
FIG. 2 is a side view of the boat lift of FIG. 1 in a position with the boat support frame lowered, and with the base on the bottom of the body of water.
Figure 3:
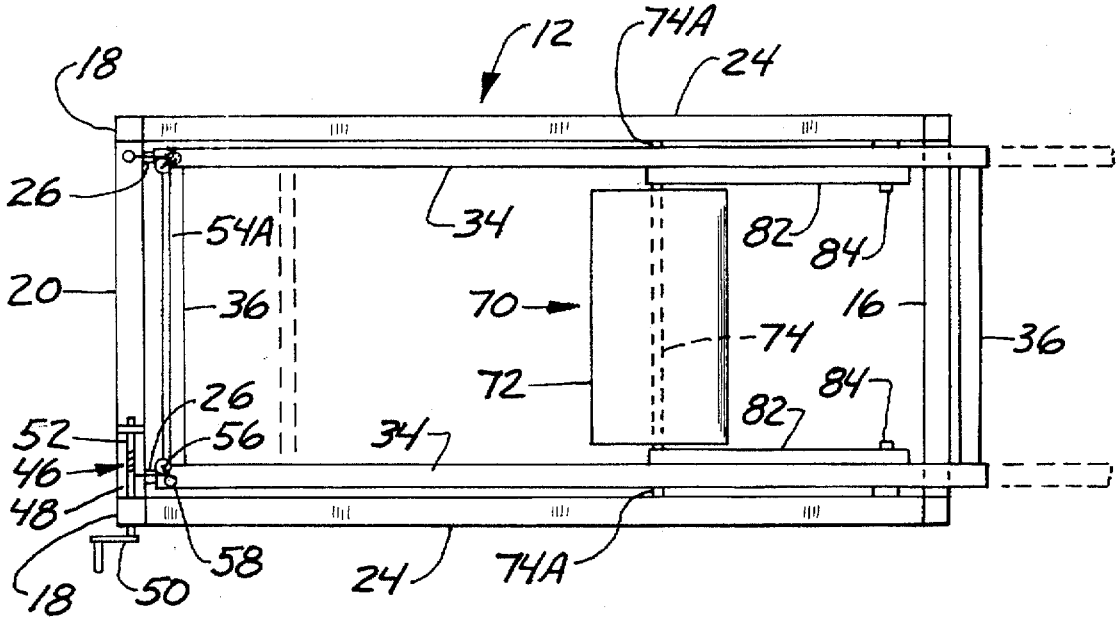
FIG. 3 is a top plan view of the boat lift of FIG. 1.

It can thus be seen that the boat support frame 32 can be moved from a raised position as shown in FIG. 1 to a lowered position as shown schematically in FIG. 2, by permitting the arms 28 and 30 to pivot on the pivot pins 26A and 42. The boat support frame 32 moves as a parallelogram so that the boat support frame 32 remains oriented parallel to the base 12 throughout its movement.

While the pivoting movement of the arms 28 and 30, and thus the movement of the boat support frame 32 can be controlled at any desired manner, the boat lift is shown as being controlled with a winch and cable assembly indicated generally at 46. A manually operated winch 48 includes a manual crank 50 that is rotatably mounted in one of the upright guide posts 18, and has a winch drum or shaft 52 that overlies the top cross member 20 between the posts 18. A cable 54 is threaded through a first pulley 56 which is attached to a swivel 58 at the shore end of one of the longitudinal stringers 34 of the boat support frame 32. The cable 54 has a length 54A that extends across the frame to a second pulley 60, which is mounted on a swivel 62 to the other of the longitudinal stringers 34 of the boat support frame 32. The cable also has a length 54B that extends from pulley 60 to be fastened to the upper end of post 18 opposite from the winch assembly 46 as shown schematically at 64. The fastening can be any desired cable termination arrangement.

Figure 4:
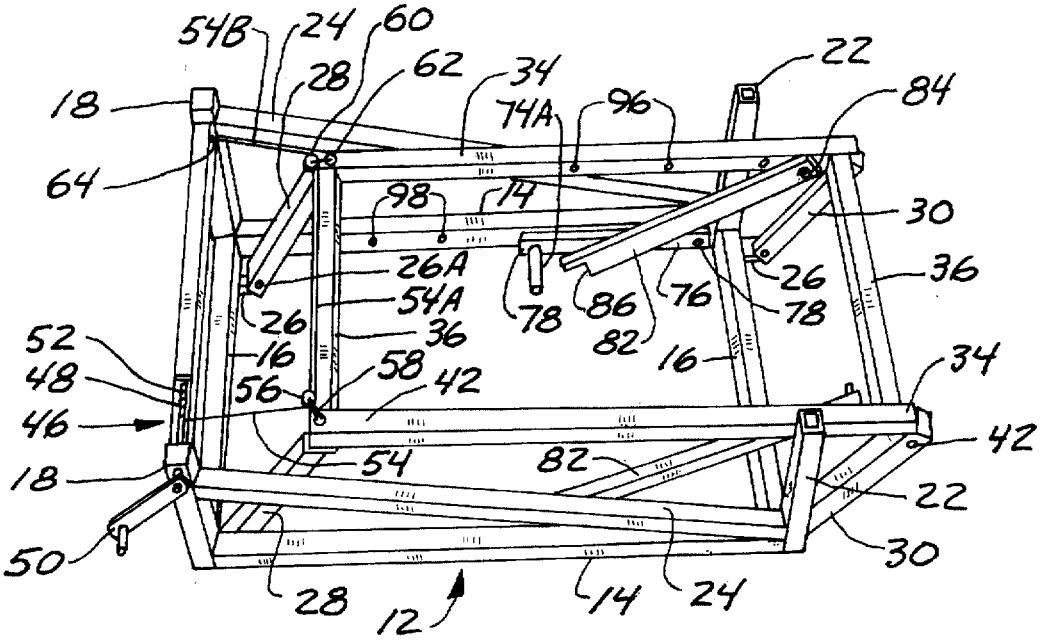
FIG. 4 is a perspective view of the boat lift in FIG. 1 in a partially raised position with a float roller removed for sake of clarity.

When the winch crank 50 is operated, the cable 54 can be lengthened, which will permit the boat support frame 32 to move to its lowered position (FIGS. 2 and 4 show partially lowered positions) from the position shown in FIG. 1. Cranking in a reverse direction will tighten the cable 54 and acting through the pulleys 56 and 60, the boat support frame 32 can be raised by the pivoting action of parallel link arms 28 and 30.

A float assembly 70 is provided to float the boat lift assembly 10 for installation and removal and also to provide a roller for supporting the boat lift assembly for moving it over the ground. The float assembly 70 includes a buoyant float roller 72 which can be suitable plastic drums that are empty, or could be a suitable, fairly durable, foam material. The float roller 72 is mounted onto a shaft 74 that preferably is rotatable relative to the float roller itself, or if desired, can be fixed relative to the roller and then the ends of the shaft 74 can be rotated in their mountings. The float roller 72 has shaft lengths 74A that extend outwardly, laterally, so that the overall length of the shaft 74 is essentially the same as the inside space between the longitudinal frame members 14, 14.

Figure 7:
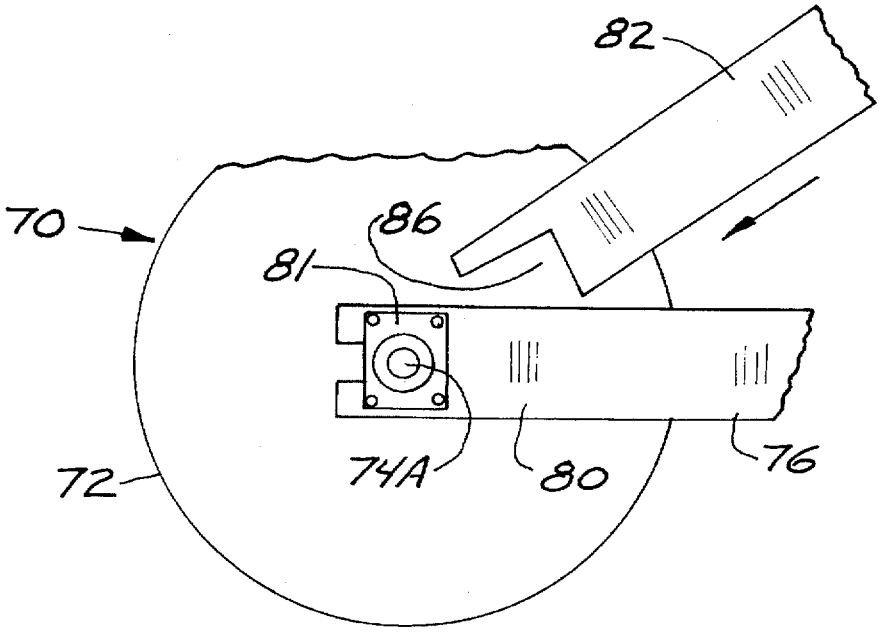
FIG. 7 is an enlarged fragmentary side view of the float roller illustrating a support arm and actuator arm used in the present invention.

A pair of float roller support arms 76, 76, are pivotally mounted as at 78 to the respective side longitudinal frame members 14 adjacent the lake end cross member 16. These arms 76 are on the inside of the longitudinal frame members 14, as can be seen, and will pivot about generally horizonal pivots that lie on a common pivot axis. The free ends of the arms 76, which are shown at 80, are adapted to receive and support the shaft portions 74A. The shaft 74 can be removable from the arms 76 if desired. This can be done by having the arms 76 as shown in FIG. 7 slotted so the shaft 74, and particularly the end portions 74A will slip into suitable guides and be held in place with lock plates or bearings 81 that can be installed relatively easily and quickly. Other attachment means for holding the shaft 74 onto the free ends of the arms can be used.

When the float roller 72 is installed on the arms 76, without any further attachments, the roller 72 will float and the arms 76 will pivot about the pivot 78.

Thus, in an ordinary situation, the float roller 72 would float on the surface of, or in, the water in order to accomplish the purposes of the invention. A pair of actuator arms 82 are pivotally mounted at 84 on suitable pins to the respective longitudinal stringers 34 of the boat support frame 32 adjacent to the cross member 36 at the lake end or the deeper end of the boat lift assembly 10. The arms 82 also may be square or rectangular cross section tubes, or channels and as shown have notches 86 at their free ends which form drive notches that will engage the shaft 74 and particularly the shaft end portions 74A. The notches can be formed by welding or securing a tab to the top wall of the tube with the tab extended out beyond the end of the arm 76. The arms 82, because of their location, are to the interior of, or spaced inwardly from the arms 76, and are adjacent the ends of the float roller 72.

The pivot for mounting arms 76 and the pivot for actuator arms 82 are at selected different pivot locations, and thus as the winch assembly 46 is operated and the boat support frame 32 moves on the parallel support arms 28 and 30 between the lowered and raised positions, notches 86 of actuator arms 82 can be engaged with the ends of shaft 74 at one of the positions in travel as illustrated schematically along the arc of travel shown in FIG. 2. Then as the boat support frame 32 is moved further to its raised position by operating the winch 46, the actuator arms 82 will create a force on the shaft 74 tending to force the shaft 74 and the float roller 72 to move downwardly toward the base 12 as the boat support frame 32 moves to its raised position.

The linkage arrangement (the mounting arms 76 and actuator arms 82) is selected so that when the boat support frame 32 is in its raised position, generally as shown in FIG. 1, at least a portion of the float roller 72 will be below the lower edge of the longitudinal frame members 14.

As the float roller 72 is forced toward the base 12, depending on the buoyancy of the float roller, as well as the number of the float rollers that are utilized, the entire boat lift may be floated in the water and moved toward the shore. As the boat lift moves toward the shore, there will be a point where the float roller 72 will engage a lake bottom indicated at 90 and the entire boat lift then can be rolled on the float roller 72 to storage.

It should be noted that more than one of the float rollers 72 can be used merely by adding another set of mounting arms 76 and actuator arms 82 at a forward location on the boat frame assembly as indicated by the dotted line position of the second float roller 72 in FIG. 1.

Referring to FIG. 4, it can be seen that there can be pivot holes 96 on the side longitudinal stringers 34 for different positioning of additional actuator arms 82, or the same actuator arms, and there can be pivot openings 98 on the side longitudinal frame members 14 for the mounting arms 76.

The mounting arms 76 will drop out of the way in the water, down along the side frame members 14 when the float roller is removed after installation, and the actuator arms 82 may be secured to the side longitudinal stringers 34 of boat support frame 32 in any suitable manner so that they are out of the way for the normal use of the boat lift but can remain in place. To remove the boat lift from the water, the boat support frame is lowered, and a floatation roller then can be connected to the mounting arms 76. The float roller 72 can be on the top of the water when it is initially installed and the mounting arms 76 pivoted up. Then, as previously mentioned, as the boat support frame 32 is raised on its parallel linkage arms 28 and 30, the actuator arms 82 can be guided so that the notches 86 engage the shaft 74 and the actuator arms will push the float roller downwardly toward base 12 as the boat support frame 32 is raised. This will cause the boat lift 10 to raise due to the buoyancy of the float roller. Complete lifting of the boat support frame causes the float roller to act as a wheel or support roller so that the boat lift can be rolled up onto the beach. In some lifts it may be necessary to have adjustable mounting arms to accommodate short vertical movement lifts. This can be done by using the arms in a shortened length on shore and then stopping in shallow water, setting the base down and lengthening the arms. Such adjustment is illustrated by the two part arm 96 in FIG. 8B having Sections 96A and 96B that can be moved longitudinally and bolted in different holes 97 of the spaced holes shown.

If desired, separate wheels may be attached to the shore end of the boat lift for rolling it onto the beach after it has been floated with a single roller. Only one of the float rollers needs to be used. It should be noted that the float roller 72 is illustrated as one assembly, but generally because of the size, barrels are used, there would be two or more such barrels, end to end on a single shaft 74.

Installation of the boat lift is an opposite process, with the boat lift in its position shown in FIG. 1, so it is rolled into the water, and then the boat support frame can be lowered by actuating the winch 50 and lengthening the cable 54. As the base 12 moves to rest on the bottom in its desired location, the actuator arms 82 would move away from the shaft 74 and the shaft 74 can then be removed from the mounting arms 76 for storage. The mounting arms 76 would merely drop down onto the bottom when the float roller is removed as stated, and the actuator arms can be secured to the side stringers 34 at that time. Then the boat lift would operate in a normal manner.

The mounting arms may be channel shaped, as showing at 90 in FIG. 8A. The arm would be used with a non rotating pipe 91 that was in the channel. The floats roller would then rotate on the pipe 91. While the parallel linkage arms are shown pivoted on the lower frame members, some lifts use cantilevered linkage arms supported above the actual base frame. The present invention works in the same manner with such lifts.

FIG. 9 is a schematic representation of a modified form of the invention that is shown only in a very schematic form for illustrative purposes. In this form of the invention, a boat lift assembly 110 includes a base 112 that has spaced apart side members as shown in the first form of the invention, including longitudinal frame members 114, and an upright frame 116 at a shore end of the base 112. The upright frame 116 is made of upright posts and cross members. Upright guide posts 118 are provided at a lake end of the stationary base 112.

A boat support frame 120 is mounted on parallel linkage arms 122 and 124, respectively, that are pivotally mounted as at 126 and 128 to the lower longitudinal frame members 114, and as at 130 and 132 to upper side longitudinal frame members 134 of the boat support frame 120. The two portions, namely the boat support frame 120 and the base 112 operate as shown in the first form of the invention by operating a winch assembly illustrated schematically at 136 that will tighten a cable 137 operating on suitable pulleys (not shown) to pivot the parallel arms 122 and 124 about their lower pivots 126 and 128, and upper pivots 130 and 132, to raise and lower the boat support frame 120.

In this form of the invention, a pair of float rollers indicated at 140 and 141 are provided with suitable shafts 142, and on the outer ends of the shafts, there are bearing type rings 143 that are connected to cables. The shaft 143 on the lake end roller 140 is attached to a cable 148 that is mounted on a suitable pulley 150 rotatably mounted at a desired location on the longitudinal frame member 114. The cable passes up with a length 148A to be held in a suitable fastener or hook arrangement 152 on the pivoting arm 122.

It is to be understood that there are two of the arms 122, spaced apart as shown in the first form of the invention, and thus there would be two of the cables 148 and the bearing rings 143. The shore end float roller 141 has a bearing ring 143 attached thereto as well, and a cable 158 is connected to the bearing ring 143 for float 141, and passes around a pulley 160 attached to the longitudinal frame member 114 on each side of the lift assembly 110 and then passing with a length 158A to a second pulley 161 which is positioned toward the lake end of the longitudinal frame member 114 a desired amount. The cable then has a length 158B that also dead ends at hook or fastener 152 on the arm 122. It can be seen, as the cable 137 is shortened, the arms 122 and 124 will move toward a more vertical position and this will cause the cables 148 and 158 to tighten to in turn pull the float rollers 140 and 141, respectively, toward the longitudinal frame members 114. The rings 143 will permit the shaft 142 and will move down very close to the longitudinal frame members 114, but stay above those members. The float rollers 140 and 141 will protrude below the longitudinal frame members 114. The float rollers form support rollers for moving the boat lift along the ground, as well as floating the boat lift.

The schematic showing in FIG. 9 is to illustrate that the actuators between the boat support frame, which can be raised and lowered in a variety of ways, using the motion of the boat lifts including cable winches as shown, or hydraulic cylinders, motors or the like, can be used for moving float rollers from the surface of the water to a position where the boat lift floats and also to a position where the float rollers will serve as wheels or rollers for moving the boat lift along the ground.

Some models of existing boat lifts cause a boat support frame to move vertically along upright posts to raise and lower a boat on the boat support frame. Such lifts may use winches and cables or hydraulic actuators for moving the boat support frame. The cables and floats, such as shown in FIG. 9 can be coupled to a vertically movable boat support frame as well, so as the boat support frame is moved vertically (either up or down), the float rollers move downwardly to cause the boat lift to be floated, and then, on shore, the boat lift is moved by rolling on the float rollers.

While not illustrated, most boat lifts have vertically adjustable feet or legs to permit leveling the boat lift to accommodate the contour of the lake bed. Typically the adjustments are made with telescoping vertical posts. The present invention permits leaving the lift floating while these adjustments are made. The present invention thus does not require having one or more people holding up the lake end of the boat lift while others adjust the posts.

Although the present invention has been described with reference to preferred embodiments, workers skilled in the art will recognize that changes may be made in form and detail without departing from the spirit and scope of the invention.

What is claimed is:

1. A boat lift assembly, comprising:

a base;

a boat support frame;

movable supports for mounting the boat support frame to the base and permitting movement of the boat support frame between a lowered position and a raised position spaced upwardly from the lowered position in a vertical direction;

at least one float roller having an axis; and an operative link for moving the float roller closer to the base as the boat support frame is moved from one of its positions to its other position, comprising a cable having cable portions, pulleys mounted on the base in position to guide the cable portions to opposite ends of the at least one float roller, the cable portions being coupled to opposite ends of the at least one float roller so as to permit rolling of the at least one float roller about its axis when coupled to the cable portions, the cable portions extending through the pulleys and being secured relative to the boat support frame such that as the boat support frame is moved in a selected direction between its lowered and raised positions, the cable portions move through the pulleys to move the at least one float roller downwardly relative to the base.

2. The boat lift of claim 1 and the operative link including a manual actuator for moving the boat support frame between its lowered and raised positions.

3. The boat lift of claim 1, wherein the movable supports for said boat support frame comprise a parallel linkage having pivot supports mounted on the base and pivot supports on the boat support frame.

4. The boat lift of claim 3 and a manual operator for moving the parallel linkage about its pivots to move the boat support frame between its raised and lowered positions.

5. The apparatus of claim 3, wherein the base includes an upright frame adjacent one end thereof, the boat support frame being movable toward and away from said upright frame between its raised and lowered positions on the parallel linkage.

6. A boat lift assembly, comprising:

a base having sides;

a boat support frame;

a parallel linkage pivotally mounted to the base at first ends thereof and to the boat support frame at second ends thereof, and pivotable to move the boat support frame between a lowered position and a raised position spaced from the lowered position in a vertical direction;

at least one float roller having an axle extending generally across said base;

a pivoting mounting arm for supporting the boat support frame relative to the base;

an actuator for moving said float roller comprising a pair of pulley members, one mountable on each of the sides of said base, a pair of cable portions, one cable portion on each side of the base supported on a respective pulley member, and a coupling to couple the cable portions to opposite ends of the axle of the at least one float roller, respectively, the cable portions being on the respective pulley member and being secured relative to the boat support frame and being of length such that as the boat support frame moves in a selected direction between the lowered and raised positions, the cable portions move through the pulleys and pull the axle and the at least one float roller downwardly to float the boat lift assembly; and an actuator for moving the boat support frame between its lowered and its raised positions.

7. The apparatus of claim 6 including an upright frame supported on the base adjacent one end thereof, the boat support frame being movable toward and away from said upright frame between its raised and lowered positions on the parallel linkage.

8. The apparatus as specified in claim 6, wherein said actuator comprises a winch assembly on the base having a cable connected to the parallel linkage.

9. A boat lift assembly, comprising:

a base;

a boat support frame having a length and a width and being configured to support a boat thereon;

movable supports for mounting the boat support frame relative to the base for guiding movement of the boat support frame from a lowered position to a raised position spaced from the lowered position in a vertical direction;

at least one float roller having an axle extending laterally across the width of the boat support frame; and the float roller and axle being selectively coupled to the boat lift assembly to move vertically downwardly to provide a floating support for the boat lift assembly as the boat support frame is moved from one of its positions to the other position.

10. The boat lift of claim 9 and an operative link including a manual actuator for moving the boat support frame between its lowered and raised positions.

11. The boat lift of claim 9, wherein the movable supports for said boat support frame comprise a parallel linkage having pivot supports on the base and pivot supports on the boat support frame.

12. The boat lift of claim 9, wherein the float roller is selectively coupled to the boat lift assembly by a mounting arm pivotally mounted on the base and supporting the axle of the float roller, and an actuator arm pivotally mounted to the boat support frame and having an end engageable with the axle of the float roller, the pivots of said mounting arm and said actuator arm being located at different locations such that as the boat support frame is moved between its positions in a selected direction, the actuator arm forces the float roller to move downwardly in an arc defined by the mounting arm.

13. The apparatus of claim 12, wherein said mounting arm has adjustment means for changing its length.

* * * * *